United States Patent [19]

Yamauchi

[11] Patent Number: 4,660,483

[45] Date of Patent: Apr. 28, 1987

[54] SEWING MACHINE CONTROL DEVICE

[75] Inventor: Satomi Yamauchi, Aichi, Japan

[73] Assignee: Mitsubishi Denki Kabushiki Kaisha, Tokyo, Japan

[21] Appl. No.: 739,594

[22] Filed: May 31, 1985

[30] Foreign Application Priority Data

May 31, 1984 [JP] Japan ..... 59-109344

[51] Int. Cl.[4] ..... D05B 69/18; D05B 69/20

[52] U.S. Cl. ..... 112/317

[58] Field of Search ..... 112/317, 316, 275, 277, 112/121.11, 262.1, 451, 453

[56] References Cited

U.S. PATENT DOCUMENTS 4,340,002 7/1982 Hanyu et al. ..... 112/453
4,509,445 4/1985 Fujikawa et al. ..... 112/317
4,548,143 10/1985 Martell et al. ..... 112/275 X

FOREIGN PATENT DOCUMENTS 3303692 8/1983 Fed. Rep. of Germany .
2009446 6/1979 United Kingdom .

*Primary Examiner*—Peter Nerbun
*Attorney, Agent, or Firm*—Sughrue, Mion, Zinn, Macpeak & Seas

[57] ABSTRACT

A sewing machine control device including a sewing machine head with a feed reversing mechanism, a position detector for detecting the position of a needle of the sewing machine head, a stitching setting mechanism for instructing the number of stitches for reverse stitching, and a reverse stitching control section for controlling the feed reversing mechanism. Sewing machine operating speed data is applied to the control section, and according to the sewing machine operating speed data thus applied, the timing of instructing the driving of the feed reversing mechanism is automatically varied. Thus, the time instant when the number of stitches actually sewed reaches the instructed number of stitches is made to coincide with the time instant when the feed reversing mechanism is actually operated.

3 Claims, 4 Drawing Figures

SEWING MACHINE CONTROL DEVICE

BACKGROUND OF THE INVENTION

The present invention relates to a device for controlling a sewing machine having a feed reversing mechanism.

A conventional sewing machine control device of this type is shown in FIG. 1. In FIG. 1, reference numeral 1 designates a sewing machine head; 2, a feed reversing mechanism; 3, a position detector for detecting the position of the needle of the sewing machine head 1, the detecting means 3 being mounted on the rotary shaft 1*a* of the sewing machine head 1; and 4, and electric motor for driving the sewing machine head 1. The torque of the output shaft 4*a* of the motor is transmitted through a pulley 13 and a belt 14 laid therearound to a pulley 15 mounted on the rotary shaft 1*a*.

Further in FIG. 1, reference numeral 5 designates a pedal; 6, a reverse stitching speed setting mechanism; 7, a stitch setting mechanism; 8, a motor control section for applying an operating signal to the motor 4 according to a signal outputted by the pedal 5 and data provided by the mechanisms 6 and 7; and 9, a feed reversing mechanism control section for driving the feed reversing mechanism 2 according to data provided by the position detector 3 and the stitch setting machanism 7.

The operation of the sewing machine control device thus contructed will be described.

The sewing machine head 1 is coupled to the motor 4. When the pedal 5 is depressed, the motor control section 8 applies the operating signal to the motor 4, causing the later to rotate, and thereby starting the sewing operation. In a reverse stitching operation, the number of stitches for reverse stitching is set by the stitch setting mechanism 7. When the pedal 5 is operated, the motor control section 8 supplies the operating signal to the motor 4 according to a speed set by the reverse stitching speed setting mechanism. The feed reversing mechanism control section 9 compares the number of stitches sewed, which is the output signal of the position detector 3, with the number of stitches instructed by the stitch setting mechanism 7, to thereby drive the feed reversing mechanism 2 for a perdetermined time period corresponding to the instructed number of stitches.

In the conventional sewing machine control device constructed as described above, the time period during which the feed reversing mechanism is driven for an instructed number of stitches is fixed. Therefore, the control device is disadvantageous in that, if the speed of the sewing machine is increased, because the feed reversing mechanism will start operating later than the time instant corresponding to the instructed number of stitches, the number of stitches actually sewed will be different from the instructed number of stitches.

SUMMARY OF THE INVENTION

Accordingly, an object of the invention is to eliminate the above-described difficulties accompanying a conventional sewing machine control device.

In accordance with the above and other objects, the invention provides a sewing machine control device in which sewing machine speed data is applied to a reverse stitching control section, and the operating timing of a feed reversing mechanism is varied according to the sewing machine speed data thus applied, so that, at any sewing machine speed, the number of stitches actually sewed is made to coincide with the number of stitches instructed by a stitch setting section.

The sewing machine control device of the invention is designed so that data representing the speed of the sewing machine and data representing the number of stitches set for reverse stitching are applied to a reverse stitching control section, whereby the timing of instructing the driving of a feed reversing mechanism is automatically varied according to the speed of the sewing machine.

The nature, principle and utility of the invention will become more apparent from the following detailed description and the appended claimed when read in conjunction with the accompanying drawings.

DESCRIPTION OF THE PREFERRED EMBODIMENTS

Figure 1:
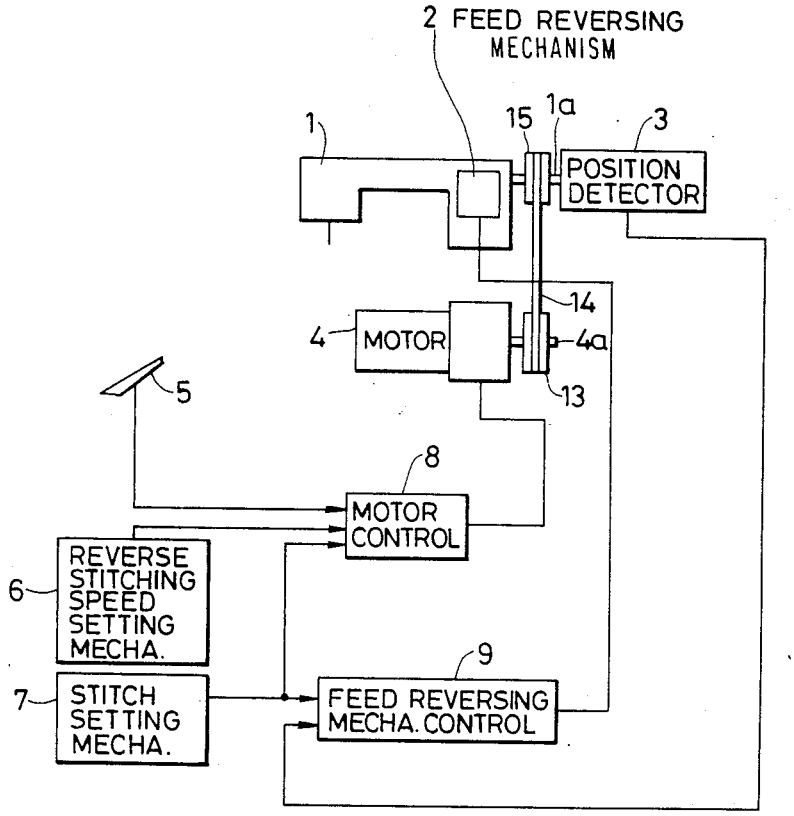
FIG. 1 PRIOR ART
FIG. 1 is a block diagram showing a conventional device for controlling a sewing machine having a feed reversing mechanism.
Figure 2:
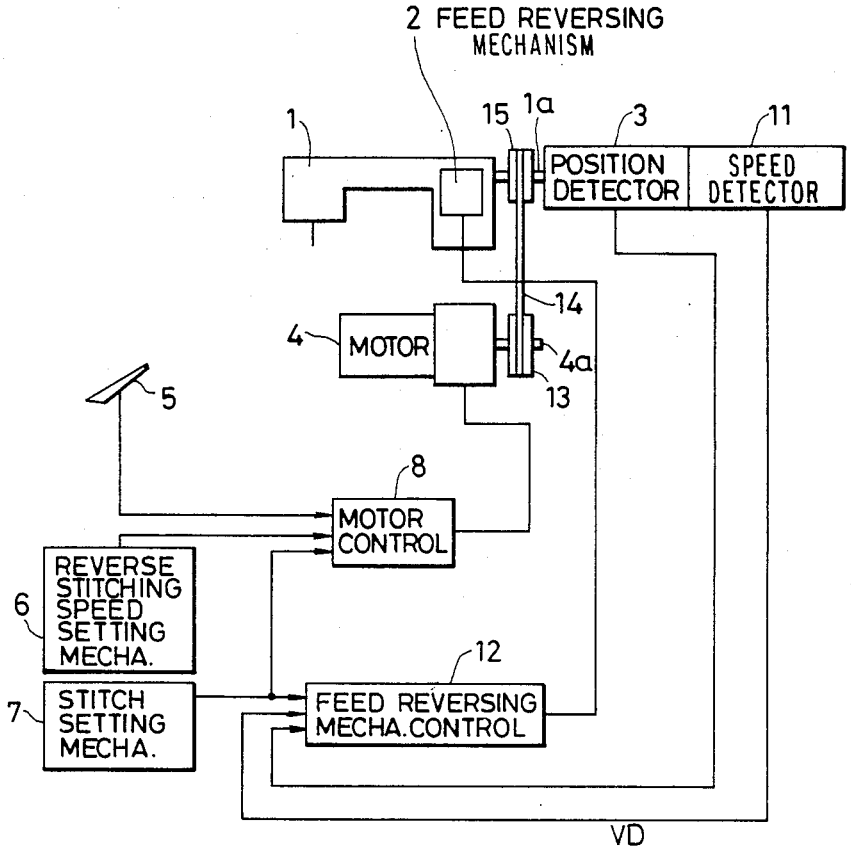
FIG. 2 is a block diagram showing an example of a device for controlling a sewing machine having a feed reversing mechanism according to the invention.

A preferred embodiment of the invention will be described with reference to FIG. 2. In FIG. 2, those components which have been already described with reference to FIG. 1 are therefore designated by the same reference character or numerals.

In FIG. 2, reference numeral 11 designates a speed detecting section mounted on the sewing machine head 1. More specifically, the speed detecting section 11 is mounted on the rotary shaft 1*a* of the sewing machine head 1 so that it rotates in association therewith and the position detector 3. Further in FIG. 2, reference numeral 12 designates a feed reversing mechanism control section provided with a speed input terminal. The control section 12 receives data from the speed detecting section 11 in addition to the data from the position detector 3 and the stitch setting mechanism 7, and drives the feed reversing mechanism 2 according to this data.

The operation of the sewing machine control device according to the invention will be described.

Figure 3:
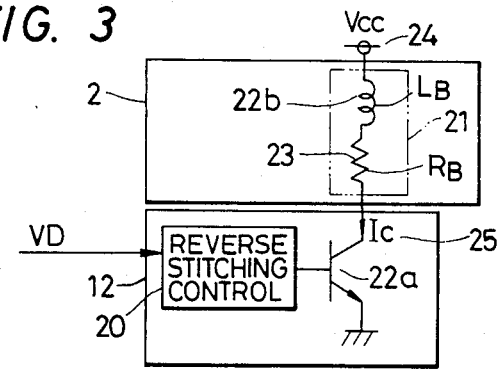
FIG. 3 is a circuit diagram showing an example of the feed reversing mechanism and an example of a feed reversing mechanism control section in FIG. 2.

In a reverse stitching operation, the feed reversing mechanism 2 starts its operation a predetermined delay time after the feed reversing mechanism control section 12 applies an operation instruction to the feed reversing mechanism 2. By way of example, it is assumed that, as shown in FIG. 3, the feed reversing mechanism control section 12 includes a transistor in its output stage, and the reverse stitching mechanism 2 has an electromagnetic solenoid. In FIG. 3, reference numeral 21 designates the reverse stitching solenoid; 22*a*, the reverse stitching transistor 22*a*; 22*b* and 23, the inductance ($L_B$) and the resistance ($R_B$) of the reverse stitching solenoid 21, respectively; 24, a power source for driving the reverse stitching solenoid 21; and 25, current ($I_C$) flowing in the solenoid 21.

When the reverse stitching transitor 22*a* is turned on, the current 25 flowing in the reverse stitching solenoid 21 increases in proportion with the electrical time constant $L_B/R_B$. When the current 25 ($I_C$) reaches a certain value, the reverse stitching solenoid 21 starts its operation.

For simplification in description, it is assumed that the reverse stitching mechanism 2 starts in a time of $L_{B/RB}$ seconds (the electrical time constant of the solenoid 21) seconds. When the speed detection section 11 detects N revolutions per minute of the sewing machine, the number of revolutions per second is N/60 ($sec^{-1}$). Therefore, in order to start the reverse stitching mechanism 2 in $L_B/R_B$ seconds, the reverse stitching mechanism control section 12 is designated so that the reverse stitching solenoid 21 is activated a period of time corresponding to $(L_B/R_B)\times N/60$ revolutions earlier than the feed reversing mechanism 2 starts its operation.

The feed reversing mechanism control section 12 includes a reverse stitching control circuit 20 which receives a speed detection signal VD from the speed detecting circuit 11. Upon reception of the speed detection signal VD representing the fact that the speed of the sewing machine is N rpm, the control circuit 20 renders the reverse stitching transistor 22*a* conductive for a period of time corresponding to $(L_B/R_B)\times N/60$ revolutions earlier than the feed reversing mechanism 2 starts. Thus, the time instant when the reverse stitching solenoid 21 operates is made to coincide with the time instant when the stitches (revolutions ) detected by position detector 3 equals the number of stitches instructed by the stitch setting mechanism 7.

Figure 4:
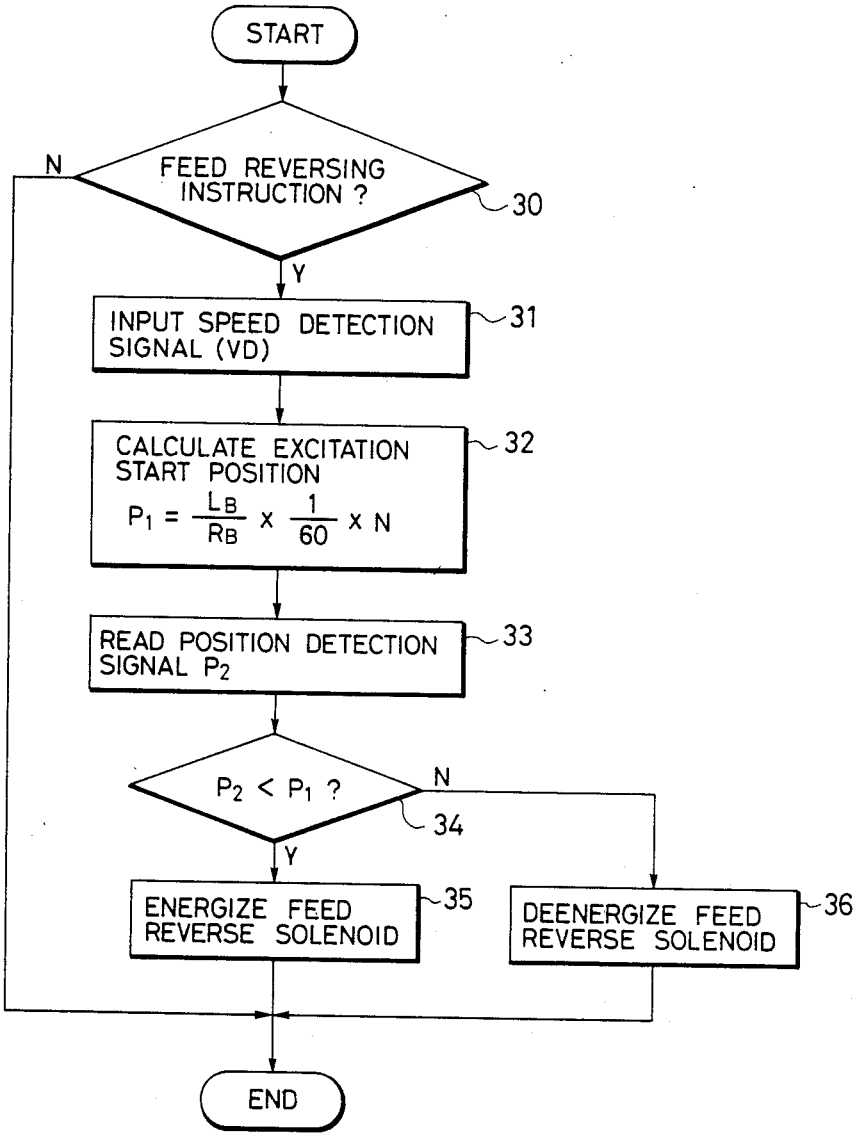
FIG. 4 is a flow chart showing an operation of the feed reversing mechanism before the feed reversing mechanism starts its operation.

The control circuit 20 of the reverse stitching control 20 includes a microprocessor having a read only memory (ROM). The data representing the inductance ($L_B$), the resistance ($R_B$), the electrical time constant ($L_B/R_B$) and the like are stored in the ROM. FIG. 4 is a flow chart showing an operation of the control circuit 20. The above described operation is processed according to the steps of (30) to (36) shown in FIG. 4.

The operation of the sewing machine control device has been described with reference to the case when the reverse stitching solenoid is energized. However, if the technical concept is also applied to the case where the solenoid 21 is deenergized, i.e., the feed reversing mechanism 2 is released, the control device will be more effective.

In the above-described embodiment, the drive source for the feed reversing mechanism 2 is a solenoid. However, the latter may be replaced by an operating mechanism such as a mechanism using compressed air. Furthermore, in the described embodiment, the speed detecting section 11 and the position detector 3 are provided separately, but an arithmetic unit for calculating speed data from the detection output of the position detector 3 may be provided for the feed reversing mechanism control section 12. That is, the following relationship is established between the position data x and the speed data v;

$$v=dx/dt$$

Therefore, the speed data can be obtained by an arithmetic operation based on the position data. More specifically, the speed data v may be obtained according to approximation as follows:

$$v=(x_1-x_2)/(t_1-t_2)$$

where $x_1$ represents a position at time $t_1$, and $x_2$ represents a position at time $t_2$.

Furthermore, in the above-described embodiment, the feed reversing mechanism 2 starts its operation in a time defined by the electrical time constant $L_B/R_B$ of the reverse stitching solenoid. However, the control device may be designated so that the feed reversing mechanism is operated after a period of time defined taking into account its mechanical time constant. In addition, if a reversible motor is employed as the motor 4, then the motor can serve as the drive source for the feed reversing mechanism.

As is apparent from the above-description, the sewing machine control circuit is designed so that the feed reversing mechanism driving timing is calculated according to the speed of the sewing machine. Therefore, with the inventive control device, the number of stitches actually sewn can be made to always coincide with the instructed number of stitches.

I claim:

1. A sewing machine including a control device, comprising:

a sewing machine head having a feed reversing mechanism;

reverse stitch setting means for instructing a number of stitches for which said feed reversing mechanism is to be operated;

position detecting means for detecting a position of said sewing machine head;

reverse stitching control means for comparing said position detection output of said position detector with a number of stitches instructed by said stitch setting means, and applying, when said position detection output coincides with said number of stitches thus instructed, a predetermined driving instruction to said feed reversing mechanism; and speed detecting means for applying a signal, corresponding to a speed of said sewing machine, to said reverse stitching control means, said control means comprising means for varying the timing of the application of the driving instruction to said feed reversing mechanism so that, according to the operating speed of said sewing machine supplied from said speed detecting means, a time instant when operation of said feed reversing mechanism is initiated is made to coincide with the time instant said number of stitches instructed by said stitch setting means is detected by said position detecting means.

2. The sewing machine control device as claimed in claim 1, wherein said feed reversing mechanism comprises a solenoid acting as a reverse stitching drive source, energization of said solenoid being controlled by said reverse stitching control means, said reverse stitching control means applying a driving instruction to said feed reversing mechanism at a time earlier than said time instant by a time interval equal to an electrical time constant of said solenoid.

3. The sewing machine control device as claimed in claim 1, wherein said reverse stitching control means comprises a transistor for controlling energization of a drive source for said feed reversing mechanism.

* * * * *